United States Patent [19]

Woodham

[11] Patent Number: 5,052,519

[45] Date of Patent: Oct. 1, 1991

[54] DISPENSING AND DEPOSITING MODULE

[76] Inventor: Gareth Woodham, P.O. Box 29, Herefordshire HR9 6PX, United Kingdom

[21] Appl. No.: 399,518

[22] PCT Filed: Oct. 14, 1988

[86] PCT No.: PCT/GB88/00866

§ 371 Date: Aug. 7, 1989

§ 102(e) Date: Aug. 7, 1989

[87] PCT Pub. No.: WO89/03467

PCT Pub. Date: Apr. 20, 1989

[30] Foreign Application Priority Data

Oct. 14, 1987 [GB] United Kingdom ..... 8724055

[51] Int. Cl.[5] ..... E04H 1/12

[52] U.S. Cl. ..... 186/37; 186/53

[58] Field of Search ..... 186/37, 36, 53, 41; 52/79.6, 79.7; 109/10, 19

[56] References Cited

U.S. PATENT DOCUMENTS

| | | | |
|---|---|---|---|
| 2,722,179 | 11/1955 | Belew | 109/19 |
| 3,348,634 | 10/1967 | Hitchins | 186/53 |
| 3,841,037 | 10/1974 | Clark | 52/79.6 X |
| 4,010,824 | 3/1977 | Bavis | 186/37 |
| 4,157,071 | 6/1979 | King | 109/19 |
| 4,557,352 | 12/1985 | Tschappat, Jr. | 186/37 |
| 4,712,650 | 12/1987 | Campbell | 186/41 |

FOREIGN PATENT DOCUMENTS

| | | | |
|---|---|---|---|
| 0034093 | 8/1981 | European Pat. Off. | 109/10 |

*Primary Examiner*—Robert J. Spar
*Assistant Examiner*—William M. Hienz
*Attorney, Agent, or Firm*—Body, Vickers & Daniels

[57] ABSTRACT

The module is a prefabricated free-standing structure with a floor 9 of reinforced concrete and, secured to the floor, a unitary body of reinforced concrete comprising a roof 5 and side walls 4 integral with the roof. There is an unimpeded approach to the structure such that an automobile 15 can be parked alongside the side wall, and the structure includes an enclosed secure repository accessible through the side wall, such that a driver seated in the driver's seat of the automobile parked alongside the side wall can either deposit articles into the repository through the wall, or conduct a secure transaction such that a selected article or articles (such as a supply of cash) stored in the repository can be dispensed to the driver.

8 Claims, 3 Drawing Sheets

DISPENSING AND DEPOSITING MODULE

The present invention is concerned with dispensing and/or depositing modules, for use, for example as "drive-in banks".

It is known to provide banking services wherein a customer may drive up in an automobile to some type of banking service means to conduct banking services. Examples of such banking service means are disclosed in PCT specification 86/06856 and U.S. Pat. No. 4,557,352.

The latter U.S. patent is concerned with banking apparatus including a plurality of islands each having a driveway adjacent thereto over which a customer may drive a vehicle, each island being provided with an automatic teller machine. The problem with such apparatus is that it can only be installed in an essentially permanent location; there are, however, many occasions where the provision of banking services at a temporary or semi-permanent location would be desirable. For example, at large exhibitions, agricultural shows and the like, it is often desirable to provide banking services; conventionally, such services are provided by means of portable buildings which are not suitable for drive-up operation.

A modular dispensing unit has now been devised which can be transported to a wide range of locations, so that banking services can be provided at a semi-permanent or temporary location. A modification of such a unit has also been devised which can be used for depositing goods, such as packages, into a secure receiving location.

According to the invention, therefore, there is provided a modular dispensing and/or depositing unit, which comprises a prefabricated structure comprising a floor of reinforced concrete and, secured to said floor, a unitary body of reinforced concrete comprising a roof and side walls integral with said roof, said structure being free standing and self-supporting on said floor; and a substantially unimpeded approach to said structure such that an automobile can be parked alongside at least one said wall, said structure including an enclosed secure repository and means for obtaining access to said repository through said at least one wall, such that a driver seated in the driver's seat of an automobile parked alongside said wall can either deposit articles into said repository via said means for obtaining access, or conduct a secure transaction such that a selected article or articles stored in said repository can be dispensed to said driver.

The floor is generally of area at least as great as the area of the base of said walls, such that it can be satisfactorily secured thereto. The structure itself, by virtue of being primarily of reinforced concrete, provides a high degree of security for the contents of the repository. In addition, the structure is very heavy (generally weighing at least 20 tonnes, such that the unit according to the invention is transportable on the back of the lorry and, in practical terms, is raisable on to the back of the lorry only by means of mechanical lifting apparatus. The unit according to the invention typically weighs at least about 26 tonnes.

It is preferred that the roof and walls of the prefabricated structure according to the invention should be a unitary precast body of reinforced concrete, and the floor is generally a substantially planar precast body of reinforced concrete.

The means for obtaining access to the repository preferably comprises means for dispensing cash, such an automated teller machine (or ATM).

It is particularly preferred that one wall of the unit according to the invention should be provided with a bulk transfer hatch for secure loading of the repository with cash through that wall, and a personnel door in that wall for personnel access to the interior of the unit. A transparent vision window is preferably provided in the wall above the bulk transfer hatch.

In one embodiment of the present invention, the prefabricated structure is further provided with a canopy extending from the wall alongside which the automobile can be parked, so as to provide a weather shelter. The canopy may be integral with the latter wall.

It is further preferred in some embodiments that a further upright wall is provided, facing the wall alongside which the automobile may be parked, so as to provide just enough room for the automobile to pass through. Where a canopy as described above is provided, this may be integral with or securely attached to the further wall described above.

By this means, an enclosed arch is provided (which may additionally be provided with a floor); such an arch is preferably of such size as to permit an automobile to be driven therethrough, preferably with a very small clearance at both sides. In this case, the modular unit according to the invention can be used as a "drive-in bank". That is, a customer may drive an automobile into the arch portion of the modular unit according to the invention, lower the driver's window in the vicinity of the dispenser, and conduct the necessary transactions with the dispenser while still remaining seated in the driver's seat of the automobile. Preferably, the arch portion is shorter than the length of a typical car; for example, the arch portion may be of length of approximately eight feet, which would permit most automobiles to protrude from front and rear of the arch portion when the driver's window of the automobile is located alongside the dispenser.

The modular unit according to the invention may be free standing or, alternatively, it may be provided on a set of wheels, from which the modular unit would generally be removed on site.

In a further embodiment of the invention, the modular unit may be secured to an anchoring means which is buried or otherwise secured to the ground (for example, such that the unit has a lifting load of up to 80 tonnes).

The repository present in the modular unit according to the invention is preferably provided with means for receiving cash or the like from an external location; such receiving means may be in the nature of a night safe or the like permitting secure deposit of cash or other valuables in the repository.

The modular unit is preferably provided with means for connection to an external electrical supply, which is preferably an underground supply.

As will be appreciated, most modern cash dispenser units (also known as automated teller machines, or ATMS) require access to remote computers via telephone lines; the modular unit according to the invention is therefore preferably provided with means for connection of said dispensing unit to a telephone network. This connection means may be, for example, a series of plug and socket connectors; alternatively, a radio transmitter and receiver may be provided, for communication with a remote transceiver. The transmitter and receiver may, for example, be adapted for communication via satellite links to a remote transceiver.

The modular unit according to the invention permits cash or the like to be dispensed in a more secure manner to the customer, who need not leave his (or her) vehicle during the operation of dispensing cash or the like. The modular unit according to the invention is therefore particularly adapted for use as a temporary or semi-permanent installation on places such as car parks, service station forecourts and at shows, exhibitions or other temporary events.

The modular unit according to the invention may be provided with means by which it may be secured to firm foundations; in any case, as described above, the modular unit according to the invention is of sufficient weight (and size also) such that it cannot be picked up without a crane, or transported without the use of a lorry or the like.

Preferred embodiments of the invention will now be described, by way of example, with reference to the accompanying drawings, in which.

Figure 1:
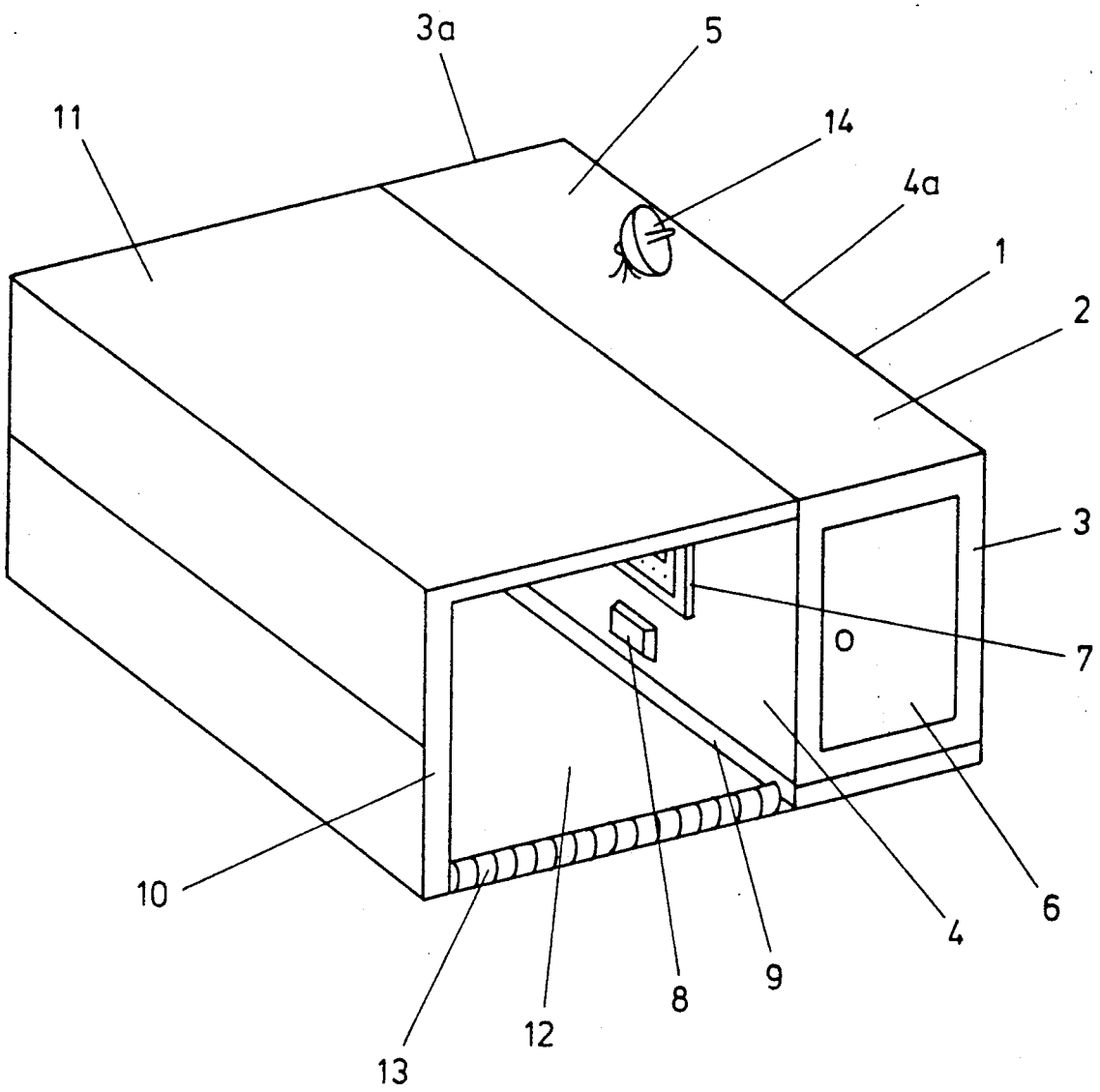
FIG. 1 is a schematic illustration of a first embodiment of modular unit according to the invention.

Referring to FIG. 1, the modular unit, generally designated 1, comprises an enclosure 2 having end walls 3,3*a* and side walls 4,4*a* and a roof 5, all of which are integrally formed of precast reinforced concrete. The enclosure further contains a secure repository or vault (not shown) for storage of cash or the like. In the end wall 3 is a secure access door 6, for permitting access to the interior of the vault only by authorised personnel. In the side wall 4 is located a cash dispenser 7 and a night safe input chute 8.

The lower edges of end walls 3,3*a*,4,4*a* all rest on and are secured to a precast reinforced concrete floor panel 9.

Spaced from, and generally parallel to side wall 4, is further wall 10 and, entirely covering the space between the side wall 4 and the further wall 10 is a roof canopy 11, and a floor portion 12 with a ramp 13 at the leading edge thereof. The spacing between walls 4 and 10 is such as to permit access by a single automobile, whereby the driver can operate the cash dispenser, without getting out of the automobile, and such that none of the doors of the automobile can be freely opened.

The enclosure is provided with means for access to a remote telephone network; in the embodiment illustrated, this means for providing access is in the nature of a transceiver 14.

Figure 2:
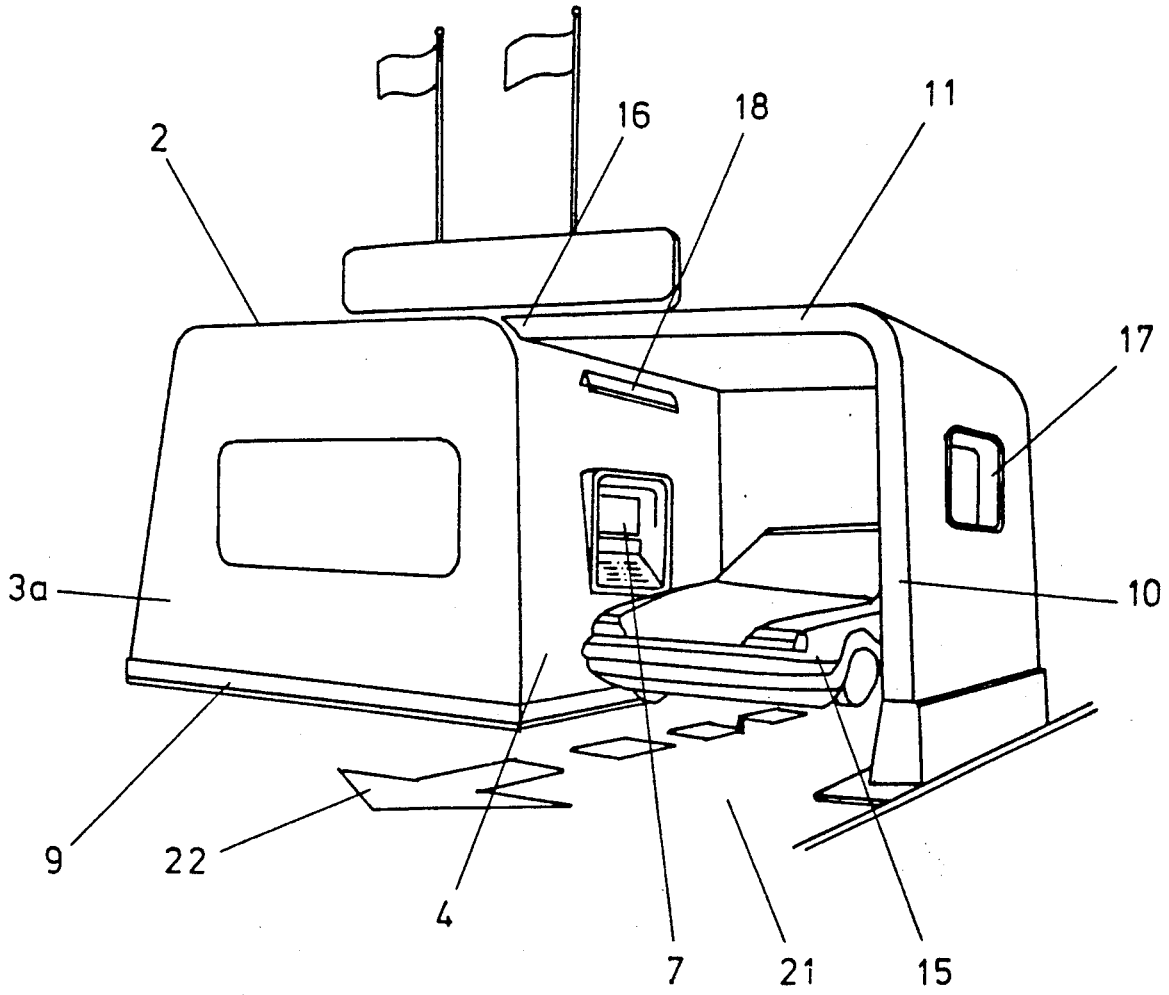
FIG. 2 is a schematic illustration of a second embodiment of modular unit according to the invention.
Figure 3:
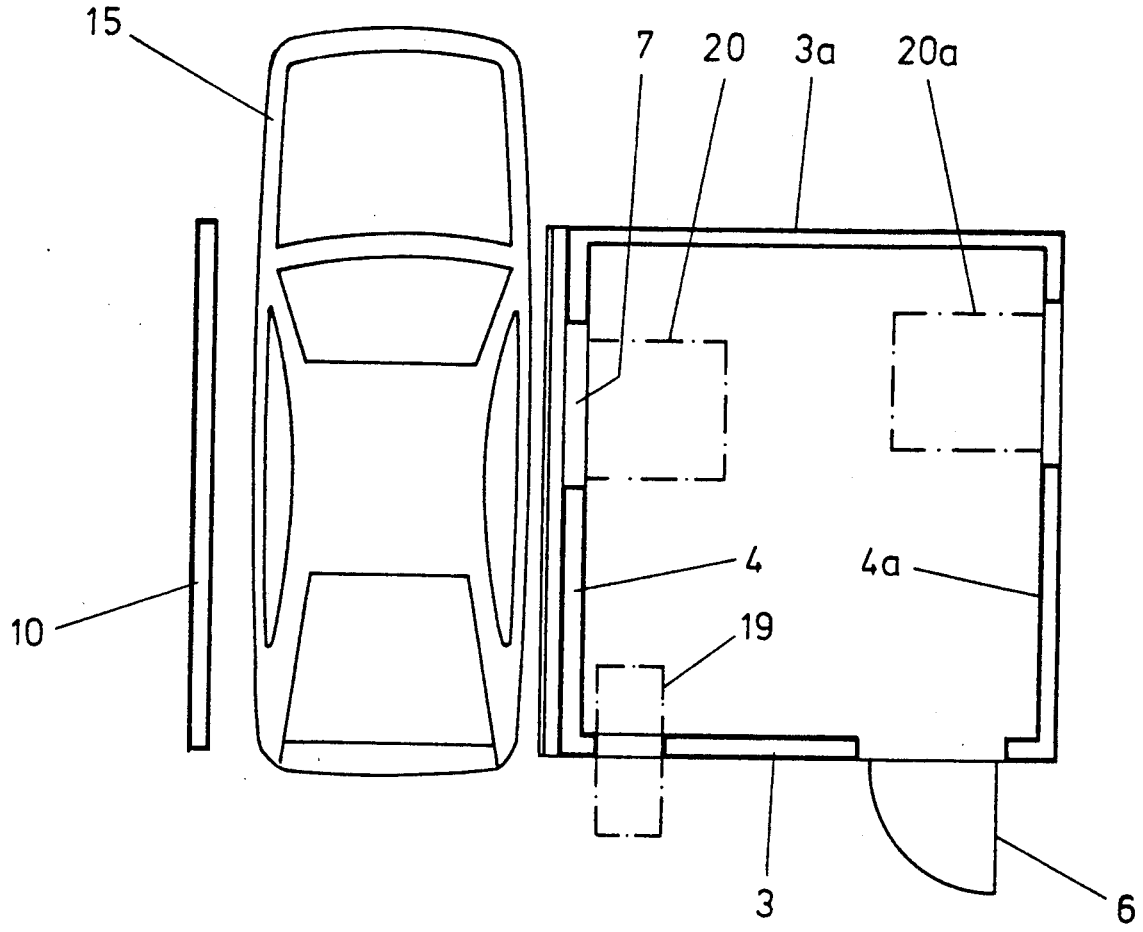
FIG. 3 is a plan view of the unit illustrated in FIG. 2.
Figure 4:
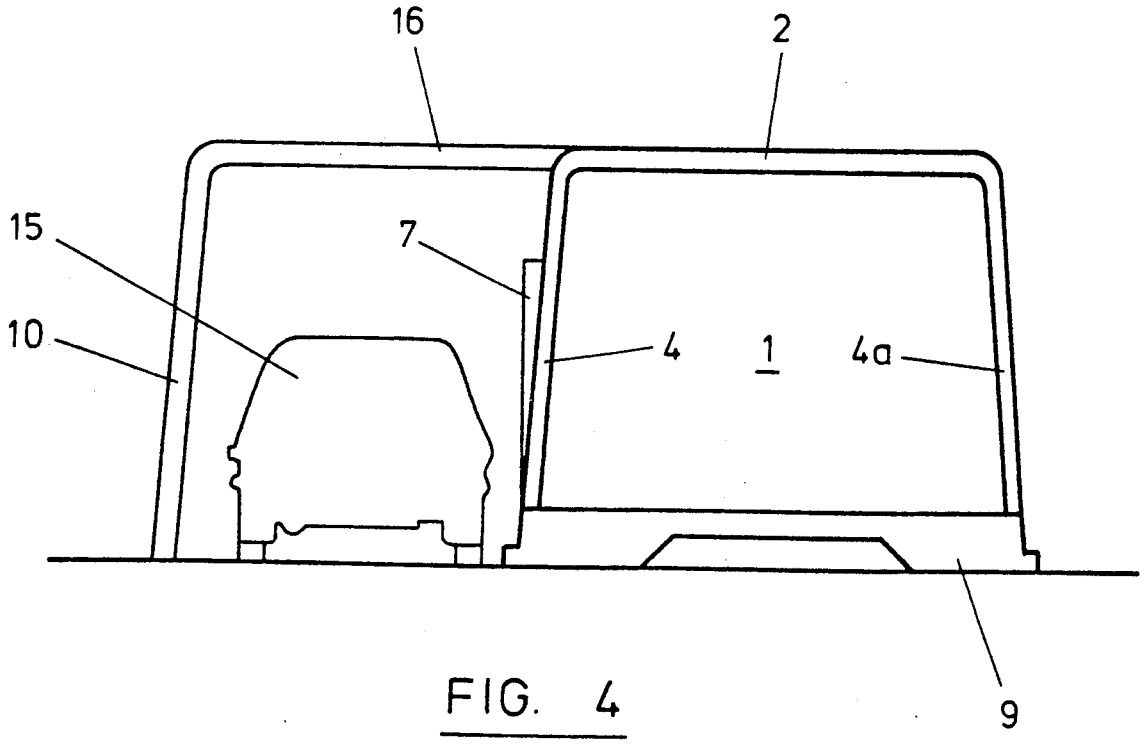
FIG. 4 is a vertical section through the unit of FIGS. 2 and 3.

Referring to FIGS. 2 to 4, in which like parts are denoted by like numerals, it will be seen that an automobile 15 is located in the space between the side wall 4 containing the cash dispenser 7 and the further wall 10. The canopy 11 and the further wall 10 are of integral construction, being integrally formed of precast concrete; one edge 16 of the canopy is secured to the top edge of side wall 4. There is no precast floor between walls 4 and 10; the automobile is on a preformed road surface 21 or the like which in the illustrated embodiment is provided with direction indicator 22. A window aperture 17 is provided in wall 10 and illumination 18 is provided in side wall 4 above the cash dispenser.

Referring to FIG. 3, the location of the bulk transfer hatch for mechanised loading of the vault with cash is shown at 19 in phantom lines; furthermore, the location of a first vault adjacent to wall 4 is shown in phantom lines 20; a further vault 20*a* (for access via a further cash dispenser in side wall 4*a*) is also shown in phantom lines. The way in which the secure access door 6 opens outward is also shown schematically in FIG. 3.

While the present invention has been primarily described in terms of a modular unit for dispensing cash or the like, a modular unit according to the invention may also be suitable for securely receiving deposited packages or the like.

I claim:

1. A modular unit for drive-in banking comprising:

a prefabricated structure including:

a precast, portable floor of reinforced concrete;

a precast, portable unitary body of reinforced concrete secured to said floor, said unitary body comprising a roof and side walls integral with said roof, said unitary body being free-standing and self-supporting on said floor;

a secure repository in said prefabricated structure;

means for obtaining access to said repository through one of said side walls; and a driveway adjacent the said one of said side walls adapted for an automobile to park alongside the said one of said side walls whereby banking transactions can be accomplished through said means for obtaining access wherein said prefabricated structure also includes said driveway.

2. A modular unit according to claim 1 in which said means for obtaining access to said repository comprises means for dispensing cash from said repository.

3. A modular unit according to claim 1, wherein said prefabricated structure is further provided with a precast canopy of reinforced concrete extending from the said one of said side walls alongside which the automobile can be parked, so as to provide a weather shelter adjacent said one of said side walls.

4. A modular unit according to claim 3, which includes a further precast upright wall of reinforced concrete facing the said one of said side walls alongside which the vehicle may be parked.

5. A modular unit according to claim 4, wherein said further upright wall is spaced from the said one of said side walls alongside which the vehicle may be parked by an amount such that the doors of an automobile located between said one of said side walls and said upright wall cannot be fully opened.

6. A modular unit according to claim 4, wherein said canopy and said further upright wall together comprise a prefabricated integral body of reinforced concrete secured to said prefabricated structure.

7. A modular unit according to claim 6, which is further provided with means for connection of said repository to a telephone network.

8. A modular unit according to claim 1, wherein said modular unit weighs at least about 20 tons.

* * * * *